US005449439A

United States Patent [19]

Heald

[11] Patent Number: 5,449,439

[45] Date of Patent: Sep. 12, 1995

[54] SUPERHEATED LOW-POLLUTION COMBUSTION OF THE GASEOUS PRODUCTS OF PYROLYSIS, PARTICULARLY IN MULTIPLE SMALL BULBOUS BURNER CUPS

[76] Inventor: Ronald Heald, 5271 Constitution Rd., San Diego, Calif. 92117

[21] Appl. No.: 197,697

[22] Filed: Feb. 17, 1994

[51] Int. Cl.[6] ..... C10B 51/00

[52] U.S. Cl. ..... 201/15; 201/27; 201/29; 202/87; 202/109; 431/5; 431/11; 431/354

[58] Field of Search ..... 201/15, 27, 29; 202/87, 202/105, 109, 112, 135, 137; 110/229, 210; 196/116; 431/232, 235, 244, 354, 5, 11, 202

[56] References Cited

U.S. PATENT DOCUMENTS

| | | | |
|---|---|---|---|
| 765,027 | 7/1904 | Matheson | 431/232 |
| 4,122,036 | 10/1978 | Lewis | 201/15 |
| 4,235,675 | 11/1980 | Bechthold | 201/29 |
| 5,302,254 | 4/1994 | Martin et al. | 201/15 |

*Primary Examiner*—W. Gary Jones
*Assistant Examiner*—Dean T. Nguyen
*Attorney, Agent, or Firm*—William C. Fuess

[57] ABSTRACT

Combustible off-gas(es) produced by the process of pyrolysis are superheated; and a pressurized gaseous mixture including oxygen, normally compressed air, is preheated; before, and by, a burning of the combustible off-gas(es) produced by process of pyrolysis in the presence of stoichiometric oxygen. The burning transpires in a large number of relatively small burner cups having bulbously-shaped and exhaust-constricted combustion chambers. The burner cups are both individually, and collectively, adjustable in their uptake of combustible gases by adjusting the flow of compressed air. The combustion in each burner cup is very complete and efficient nonetheless to having increased area contact with the chamber wall, and nonetheless to the rapidly and turbulent flow of gases, because everything contributing to or touching the combustion reaction is optimally hot, and because the shape of the burner cups holds the combustion optimally long. An optional control system monitors each of the temperature and the vacuum/pressure of the retort within which pyrolysis transpires so as to hold constant the conditions for optimum pyrolysis, feeding carbonaceous material to the retort faster when the temperature drops while simultaneously increasing the flow of compressed air to the many burner cups.

12 Claims, 6 Drawing Sheets

SUPERHEATED LOW-POLLUTION COMBUSTION OF THE GASEOUS PRODUCTS OF PYROLYSIS, PARTICULARLY IN MULTIPLE SMALL BULBOUS BURNER CUPS

BACKGROUND OF THE INVENTION

1. Field of the Invention

The present invention generally concerns the disposal of waste, including hazardous waste, by the process of incineration. The present invention particularly concerns improvements to (i) the combustion of off-gas(es) produced by the process of pyrolysis, (ii) the shape and size of the burner within which off-gas(es) produced by the process of pyrolysis undergoes combustion, and (iii) the control of temperature at which pyrolysis transpires.

2. Description of the Prior Art 2.1 Classic Liquid-Injection Incineration

Most of the vast numbers of solid, liquid and occasionally gaseous material identified as hazardous waste are subject to thermal breakdown. Many types of waste, especially including petroleum wastes, also contain thermal energy, and are combustible.

Various forms of incinerators are most commonly used to handle liquid hazardous waste as well as hazardous wastes of other forms, i.e., solids sludges, slurries and fumes. In the field of hazardous waste incineration, there is more experience with liquid injection incinerators than all other types combined, with over half of all incinerators in use circa 1981 being of this type. In a liquid injection incinerator a pumped liquid is burned directly in a burner (combustor) or injected into the flame zone of the incinerator chamber (furnace) via nozzles. The heating value of the waste is the primary determining factor for nozzle location.

Liquid-injection incinerators are usually refractory-lined chambers in any of horizontal or vertical configurations, generally cylindrical, that are equipped with waste- and/or auxiliary-fuel-fired primary combustors and often also secondary combustors for low-calorific value materials such as aqueous wastes containing organic an/or inorganic compounds. The liquid-injection incinerators commonly operate in the approximate range from 1000° C. to 1700° C., with residence time in the chamber varying from milliseconds to a few seconds. With atomizing injectors high viscosity fluids of up to 4,500 SSU are capable of being incinerated.

All liquid-injection incinerators handling government-numerated hazardous waste compounds must meet the basic requirements of 40 U.S. Code of Federal Regulations Subpart 0-Incinerators. These regulations require: 99.99% destruction and removal efficiency (DRE) of the principal organic hazardous constituent (POHC); 99% removal of hydrogen chloride; and stack emissions not to exceed 180 mg. per dry standard cubic meter.

That this regulations can be met is proven by the large number of conforming liquid-injection incinerators in operation. However, these criteria are difficult to meet, especially for waste steams that vary in any of physical, chemical or thermodynamic properties.

The present invention will be seen to be flexible over a broad range, and at short times, to encompass significant variations in any of the physical, chemical or thermodynamic properties of the hazardous waste that is disposed of.

The burner(s) and/or combustion chambers of liquid-injection incinerators are normally quite large, on the order of cubic meters ($m^3$), as are the incinerators themselves. This large size is predicated on the volume of hazardous waste stream for which it is economical to build an incinerator to dispose of. Even more intrinsically important, this large size is predicated on the thermodynamic requirement of sustaining a combustion, and normally a 1000+° C. hot combustion, without any undue "quenching" of the combustion, and/or degradation of its efficiency, by contact of the combustion reaction with the generally cooler walls of the combustion burner, or chamber.

The present invention will be seen to function oppositely, achieving efficient and hot combustion in combustion burners, or "cups", that are relatively small, on the order of a few cubic centimeters ($cm^3$).

The parameters, temperature, confinement, etc., of the incineration of mixed-waste streams, liquid or not, are often inherently contradictory. For maximum destruction and thermal breakdown of a principal organic hazardous constituent (POHC) the temperature is normally desirably high, and the dwell time long of the reaction long. Of course, a very long dwell time interferes with the incineration of fresh combustible material, and lowers the temperature of incineration due to the accumulation of the products of combustion in the incineration. For maximum destruction and thermal breakdown of a principal organic hazardous constituent (POHC) the incineration would normally best transpire in the presence of stochastic oxygen, and with turbulence so that the supplied oxygen is well reacted. One simple way to add oxygen to the incineration process is to supply abundant air to the process. But the air may cool the incineration temperature, diffuse the combustible material, and/or reduce the dwell time during which the incineration transpires. Finally, if the incineration is admirably hot for maximum destruction and thermal breakdown of the principal organic hazardous constituent (POHC), then the incineration may be so hot so as to cause miscellaneous materials and contaminants int he hazardous waste steam, primarily metals, to be undesirably taken up into the gases of the incineration, and emitted.

2.1 Classic Pyrolysis

Pyrolysis, sometimes referred to as thermal decomposition or destructive distillation, is defined as the destructive distillation of a stream of carbonaceous material in the presence of heat and in the absence of stoichiometric oxygen to produce (i) an off-gas with a combustible content and (ii) char. Application of pyrolysis to the treatment of waste, including hazardous waste, leads to a two-step disposal process. In the first step, the wastes are heated, normally in the complete absence of oxygen, in order to separate volatile components of combustible gases, water vapor, etc., from non-volatile char and ash. In the second step, (i) the volatile components are burned in the presence of a gaseous mixture containing oxygen in order to incinerate all noxious and/or hazardous components as best and as completely as is possible, while (ii) the solid char and ash is disposed of as solid waste.

Several variations of waste treatment by pyrolysis include (i) energy recovery and/or (ii) recovery of solid components from the volatile components an/or solid residual.

High-efficiency low-emission reduction of hazardous waste by the two-step processes of (i) pyrolysis and (ii)

burning presents at lest two challenges. First, the heat of the pyrolysis reaction is desirably kept very nearly constant at a level that establishes the proper and desired balance between the solid char and off-gas(es) produced, and that never becomes so hot so as to, for example, force metals into the stream of off-gas(es). However, if the waste stream varies in its thermal component and/or thermal absorption, both of which are common, then the heat of pyrolysis is difficult to control.

Second, the solid char contains some combustion energy, even if it is not desired to liberate this energy by burning because of the (typically considerable) negative consequences, typically pollution emission, attendant upon any burning of the char. (The char is normally buried, or incorporated in the matrix of another material such as asphalt.) The combustion energy of the off-gas(es) is thus equal to the combustion energy of the original waste stream diminished by the combustion energy remaining in the char. The combustion energy of the off-gases is usually considerable, but no more so than is needed to establish a combustion temperature when burning the off-ga(es) that is optimal for reduction of noxious and/or odorous components within the off-gases (and/or the off-gases themselves). Accordingly, when pyrolysis is conducted than the disposal of hazardous waste has only begun, and much attention would desirably also be paid to the subsequent combustion of the off-gases produced by the classical process of pyrolysis.

SUMMARY OF THE INVENTION

The present invention contemplates an improvement to the process and the apparatus for burning combustible off-gas(es) produced by the process of pyrolysis. The improvement includes, in part, (i) superheating the produced off-gas, and also (ii) preheating a gaseous mixture including oxygen, normally air, before (iii) burning the produced gas in a large number of relatively small bulbously-shaped burner cups.

The present invention further contemplates multiple arrayed burner cups of a particular, relatively small and bulbously-shaped, configuration within which a stream of combustible gases, such as may arise as a product of pyrolysis, are very completely and controllably incinerated in the presence of pressurized air. Among other characteristics, the relatively small bulbously-shaped burner cups are individually, and collectively, adjustable in their uptake of combustible gases by adjustment of the flow of pressurized air.

The present invention still further contemplates a control system for holding constant the temperature of a retort within which a stream of carbonaceous material is destructively distilled by process of pyrolysis. The control system operates to monitor each of (i) the temperature and (ii) the vacuum/pressure of the retort so as to (i) feed carbonaceous material to the retort faster when the temperature drops while (ii) increasing the flow of compressed air to a number of burners where the off-gas produced by pyrolysis of the carbonaceous material is incinerated.

1. Improvement to the Process and the Apparatus for Burning Combustible Off-gas(es) Produced by the Process of Pyrolysis In one of its aspects, the present invention constitutes an improvement to the process and the apparatus of waste disposal by pyrolysis where a stream of carbonaceous material is destructively distilled in the presence of heat and in the absence of stoichiometric oxygen to produce (i) an off-gas with a combustible content and (ii) char, and where the combustible off-gas is further burned to produce (i) heat and (ii) combustion products including undesirable and/or odorous gaseous and/or particulate emissions.

The process improvement of the present invention is specifically directed to incinerating the combustible off-gases very completely and very efficiently so that undesirable and/or odorous gaseous or particulate emissions are minimized. In the improved process, such very efficient and very complete burning of the pyrolysis-produced off-gas(es) results from incineration at (i) abnormally high temperatures over (ii) an abnormally protracted period of time.

This very high temperature, and relatively protracted, incineration transpires both by virtue of, and nonetheless to, the burning of the off-gas(es) in a great number of relatively small burner cups. The burner cups are of such a small size as would normally serve, by an increased area contact of combustion reaction with the burner cup walls, to lower the temperature of combustion and thus adversely affect the efficiency of combustion. Moreover, the burner cups are intentionally of a shape that serves to constrict the outflow of the combustion products, such as would normally serve, by a resulting accrual of the products of 10 combustion in the combustion reaction, to again lower the combustion temperature and to again adversely affect the combustion efficiency. In partial mitigation of, and compensation for, these adverse effects, the combustion of pyrolysis off-gas(es) transpiring in the relatively-small relatively-constricted burner cups can be, and is, relatively finely adjusted, regulated and maintained.

Bluntly restated, in its first aspect the present invention concerns the precision combustion of the off-gas(es) produced by pyrolysis (i) at a temperature that is very high relative to the best obtainable from the specific heat(s) of combustion of the off-gas(es) being incinerated, and (ii) over a time interval that is protracted relative to conventional incineration in existing burners, in order that very complete and efficient incineration, with minimal undesirable and/or odorous gaseous emissions, may be realized. Exactly how this interesting result is achieved is the subject of the following sub-sections 1.1–1.7.

1.1 The Off-Gas Produced by the Pyrolysis is Superheated, Forcing Its Molecules to High Energies and Large Separations Where They May Be More Completely Reacted The improvement to the process of waste disposal by pyrolysis, and specifically the incineration of produced off-gas(es), in accordance with the present invention begins with a superheating of the off-gas(es) that is (are) produced by pyrolysis by use of at least some of the heat resulting from combustion of the off-gas(es) that was (were) produced at an earlier time. Because the pyrolysis-produced off-gas(es) is (are) already hot, its (their) further heating is called "superheating".

This superheating is hypothesized to drive (under equal gaseous pressure) the molecules that are within the off-gas(es) to a higher energy, and to a higher degree of separation. This greater energy, and separation, of the molecules in the superheated off-gas(es) is hypothesized to permit the off-gas(es) to be burned with greater efficiency and with less undesirable and odorous gaseous emissions than if the superheating had not transpired.

1.2 The Superheated Off-Gas is Reacted With Oxygen, Normally the Oxygen in Air, That Flows Under Pressure Forces The improvement to the process of pyrolysis in accordance with the present invention continues with a stoichiometrically burning of the superheated off-gas(es) in the presence of a forced flow of a gaseous mixture containing oxygen. The forced flow is typically of pressurized, or compressed, air.

Any burning of the off-gas(es) of pyrolysis, superheated or not, is necessarily in the presence of oxygen, such as is the definition of burning. However, the oxygen is not known to the inventor to have previously been supplied in stoichiometric quantities for at least two reasons. First, a supply of oxygen in stoichiometric quantities, especially as compressed gas, may lower the temperature of burning, potentially resulting in less complete burning with more gaseous and/or particulate pollution emission(s) than would have transpired in the presence of sub-stoichiometric levels of oxygen. Second, if the oxygen, or air, is pressurized, and rapidly flowing into the zone of burning then it may "sweep" the combustion reaction over an increased volume, again resulting in a lowered temperature of burning and potentially less complete burning with more gaseous and/or particulate pollution emission(s) than would have transpired in the presence of sub-stoichiometric levels of oxygen. The manner in which the improved process of the present invention serves to keep the burning hot and long even though oxygen is injected in stoichiometric quantities is next immediately discussed.

1.3 The Superheated Off-Gas is Reacted With Oxygen, Normally in Air, That Is Heated The improvement to the process of pyrolysis in accordance with the present invention continues with a preheating of the forced flow of the gaseous mixture containing oxygen by use of at least some of the heat resulting from combustion of the off-gas(es).

Accordingly, in the preferred embodiment of the improved pyrolysis method of the present invention, both (i) the off-gas(es), and (ii) the gaseous mixture containing oxygen, are heated prior to so being burned. The combustion of the heated gases can fairly be said to be very hot, and thus suitable to reduce the undesirable and odorous gaseous emissions to the extent that the off-gas is more efficiently and more completely burned under very hot conditions of combustion. (Most off-gases are so more efficiently and more completely burned under very hot conditions of combustion.)

In fact, in one preferred, and extreme, variant of the improved pyrolysis-based waste disposal method of the present invention, substantially all of the heat energy resulting from burning of the off-gas(es) is used for jointly (i) superheating of off-gas(es), and (ii) preheating of the forced flow of the gaseous mixture containing oxygen. In this variant both the (i) off-gas(es) and the (ii) gaseous mixture containing oxygen are jointly (but not necessarily evenly) heated by use of essentially all the energy that is available from the combustion of the off-gas(es) with the gaseous mixture containing oxygen.

Because energy recovery from the burning of the off gas(es) is forgone, with the energy of burning being fed back into the combustion process, the combustion of the off-gas(es) is, by definition, just as hot as its specific energy of combustion will permit, and is normally very, very hot. Such very, very hot combustion conditions are again suitable to reduce the undesirable and/or odorous gaseous pollutant emissions to the extent that the off-gas(es) is (are) more efficiently and completely burned under such very very hot conditions of combustion.

1.4 The Very Hot Burning of the Superheated Off-Gas With The Oxygen Contained Within the Heated and Pressurized Air Transpires in a Large Number of Relatively Small Burner Cups Where the Burning is Precisely Controllable Still further in accordance with the improvement to the process of pyrolysis in accordance with the present invention, the superheated off-gas(es) is (are) incinerated in the presence of preheated and pressurized gaseous mixture containing oxygen, normally compressed air, in a multiplicity of walled burner cups that are (i) numbered and (ii) sized so that each produces a substantially clean flame of combustion. For most off-gases having associated specific heats of combustion similar to natural gas (methane), this optimal size means that the burner cups are relatively small, having combustion chambers on the order of a cubic inch in volume, and more reminiscent of a household gas stove than the typically gigantic burners commonly involved in waste incineration.

Such small burner cups have, by and large, heretofore been rejected for the burning of gas(es) having potentially noxious products of incomplete or inefficient combustion because the burning is potentially quenched by increased area contact of the combustion with the walls of the burner cup. The present invention turns this supposed limitation of small combustion chambers to advantage by at least three strategies.

First, the gases burned in the burner cups are already hot. Any quenching of the combustion reaction by contact of the combustion components, or the combustion products, with the walls of the burner cups is substantially inconsequential because both the (i) off-gas and the (ii) gaseous mixture containing oxygen (e.g., the air) are already very hot prior to combustion, and their combustion in even a multiplicity of burner cups can still fairly be said to be very hot.

Second, the burning is optimized. The burning transpiring in the multiple burner cups is both (i) individually and (ii) collectively adjustable. Adjustment of the combustion in an individual burner cup occurs by adjusting the flow of compressed air into the individual burner cup. Once the burning in all burner cups is individually optimized, compensation for changes in the rate or nature of the material(s) undergoing pyrolysis, and the produced off-gas, transpires by adjustment of the flow of compressed air to all the multiple burner cups.

Third, loss of heat energy from the relatively small burner cups is minimized, and such energy lost as transpires is substantially only to the un-combusted off-gas(es) and to the compressed air. The burner cups are physically closely arrayed, and are thermally connected by a common metal mount. Moreover, the metal mount is preferrably the solid roof of a chamber within which chamber is flow-conducted the superheated off gas(es) on their paths to the arrayed burners. Moreover, a conduit, or tube, by which compressed air is flow-conducted to each burner cup passes through the chamber. The thermal energy of combustion between the off-gas(es) and compressed air containing oxygen within the arrayed burner cups is conducted away from the burner cups by (i) the mount, and (ii) the tube. But these members, and this energy, serves primarily only so as to heat the incoming gases, making that but little energy is lost to the system.

1.5 The Superheated Off-Gas Reacts More Slowly and Completely With the Oxygen in the Heated Air Than Would Normally Occur Under Force of The Air's Pressured Flow Because the Burning Not Only Transpires In Burner Cups That Are Relatively Small, But That Are Bulbously-Shaped and Constricted As Well Still further in accordance with the present invention, each of the multiplicity of walled burner cups is of such a structure as serves to impede and restrain such a full and free flow of the combustion products from the cup as would normally result from, among other gas dynamical forces including those resultant from the products of combustion, the force of the pressurized flow of the gaseous mixture containing oxygen into the cup.

A preferred burner cup includes both (i) a screen and (ii) a bulbously-shaped combustion chamber. The (i) screen slows the speed of the mixing of the off-gas and the pressurized gaseous mixture containing oxygen (e.g., air), as well as promoting thorough mixing. The bulbously-shaped combustion chamber has a greater circumference in the region immediately above the screen where burning transpires than is presented by an exhaust port (at the top of the chamber) through which the products of combustion are vented.

Normally any impediment to the escape of the combustion products from a burner cup would be extremely deleterious, and would serve to decrease the efficiency, and increase the undesirable and odorous gaseous emissions, of combustion. However, in accordance with the present invention, combustion transpire even more completely in the bulbously-shaped, screen-constricted, burner cups than it would transpire if the burner cups were not so shaped and constricted. This is because both the (i) off-gas and the (ii) gaseous mixture containing oxygen are already very hot, and their combustion, even when the escape of the combustion products is impeded, is still very hot. Moreover, because this very hot combustion in the multiplicity of burner cups transpires over a longer period of time than would be the case if the escape of the combustion products was not impeded, the combustion transpires more completely, and results in still optimally reduced undesirable and odorous gaseous emissions of combustion.

1.6 The Preferred Small, Bulbously-Shaped, Screen-Constricted Closely-Arrayed Burner Cups Waste Little Energy Still further, in accordance with the present invention, the multiplicity of walled burner cups, each of such a structure as serves to impede and restrain such full and free flow of the combustion products from the cups, are (i) closely arrayed (ii) at a particular location, and in a particular thermal relationship, to other system components.

All the burner cups are preferably located in an area that is under each of (i) a retort in which pyrolysis transpires, (ii) a part of the gas conduit serving to convey the produced off-gases to the burner cups, and (iii) a part of the compressed air conduit that convey compressed air to the burner cups. (A remaining a part of the gas line serving to convey the produced off-gases to the burner cups is in the form of a plenum, or chamber, having a top within which the burner cups are affixed. The produced off-gases enter from the plenum into the burner cups. A remaining part of the compressed air conduit that conveys compressed air to the burner cups is in the form of a number of lines, or tubes, passing through the plenum each directly to a respective burner cup.) The exhaust gases resulting from the combustion in the burner cups serves to heat all that is located above the burner cups, and particularly (i) the retort, (ii) the part of the gas conduit, and (iii) the part of the compressed air conduit.

The burner cups that are closely proximate to each other and to the retort and gas lines that they serve to heat assume a high temperature, and effectively lose but little energy while maintaining a high temperature of combustion.

1.7 Subsuming Principle of the Process and Apparatus Improvements in Accordance With the First Aspect of the Present Invention If the six individual improvements of the first aspect of the present invention are considered collectively, it may be recognized that all are consistent with a single principle: preferrably all the energy that is left over from the burning of off-gases produced by pyrolysis that is not used in the pyrolysis itself (i.e., in heating the retort in which the pyrolysis transpires) should be used to promote (i) the temperature and (ii) the duration of the burning of the off-gas(es) produced by the pyrolysis so that this burning may transpire very completely, and with minimal emissions.

This principle is not opposite to the aims of combustion of the off-gas(es) of pyrolysis for purposes of supplying heat to an outside sink, i.e., heat recovery from the combustion of waste. The principle of the present invention simply means that heat energy should be extracted from the system, if at all, only at a late point in the system processes, and likely in moderation. In the improved waste disposal method of the present invention, all or nearly all of the heat energy of combustion is first turned inward, and used to make the combustion hotter, longer and cleaner.

2. Adjustable Combustion in a Large Number of Relatively Small Bulbously-Shaped Burner Cups Further in accordance with the present invention, disposal of a stream of combustible gases transpires by incinerating the gases in the presence of pressurized air in a large number of relatively small, bulbously-shaped, burner cups. Each burner cups has (i) a screen to slow the speed, and promote, the mixing of the off-gas and the pressurized gaseous mixture containing oxygen (e.g., air), and (ii) a bulbously-shaped combustion chamber having a greater circumference than is an exhaust port (at the top of the combustion chamber) through which the products of combustion are vented. The burner cups are individually, and collectively, adjustable in their uptake of combustible gases adjusting the flow of pressurized air into all the burner cups in common, and also to each burner cup individually.

3. A Control System for Holding Constant the Temperature of A Retort in Which Pyrolysis Transpires Still further in accordance with the present invention, a control system holds constant the temperature of a retort within which a stream of carbonaceous material is destructively distilled by process of pyrolysis.

The control system monitors each of (i) the retort temperature and (ii) the retort vacuum/pressure. Carbonaceous material is feed to the retort faster when the temperature drops. This stream of carbonaceous material undergoes conventional pyrolysis in the presence of heat and in the absence of stoichiometric oxygen to produce (i) an off-gas with a combustible content and (ii) char. Naturally, more of both (i) off-gas and (ii) char are produced when the feed of carbonaceous material is increased.

The combustible gas is routed, preferably after being superheated, to a large number of burners. The burners also receive pressurized air, preferably air that has been preheated as well as pressurized. Although an individual burner can be adjusted so as to consume more compressed air, and more of the combustible off-gas, the control system preferably serves to adjust the rate at which pressurized air is supplied to the large number of burners. An increased flow of compressed air to the burners causes more combustible off gas to be consumed while maintaining the same oxygen to combustible ratio and high efficiency of combustion.

These and other aspects and attributes of the invention will become increasingly clear upon reference to the following drawings and the attached specification.

DESCRIPTION OF THE PREFERRED EMBODIMENT

The following description is of the best mode presently contemplated for the carrying out of the invention. This description is made for the purpose of illustrating the general principles of the invention, and is not to be taken in a limiting sense. The scope of the invention is best determined by reference to the appended claims.

Figure 1:
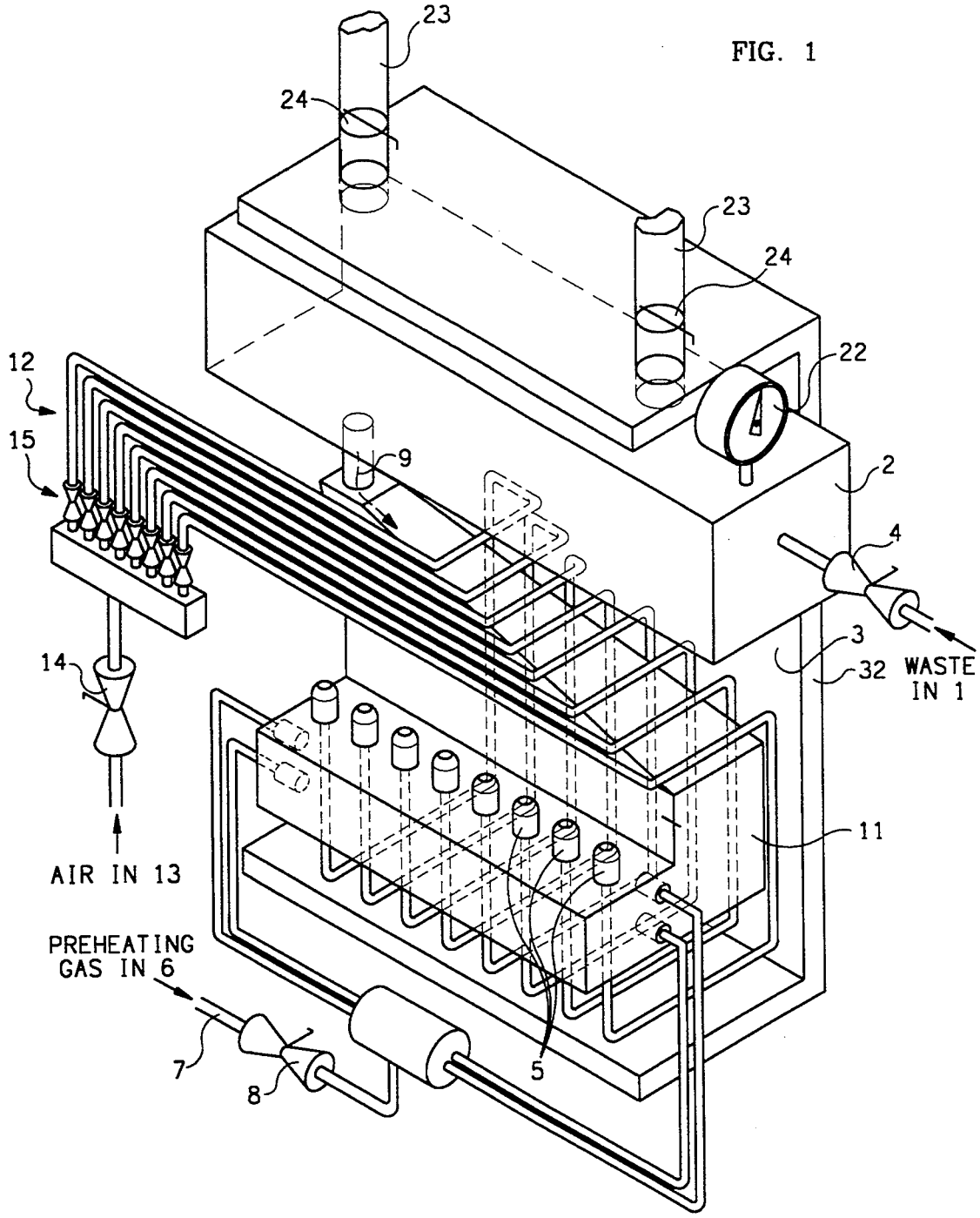
FIG. 1 is a diagrammatic representation of the improved process and apparatus for the incineration of combustible off-gas(es) produced by the process of pyrolysis in accordance with the present invention.

A diagrammatic representation of a first embodiment of the improved process and apparatus for the incineration of combustible off-gas(es) produced by the process of pyrolysis in accordance with the present invention is shown in FIG. 1. A stream of carbonaceous WASTE IN 1, for example a liquid waste steam consisting of waste oil, is received into a retort tube 2 completely located within a furnace 3 through a valve 4. The WASTE IN 1 undergoes pyrolysis in the retort tube 2 (i) in the absence of stoichiometric oxygen and (ii) the presence of heat provided by combustion transpiring in arrayed burner cups 5.

The temperature of the retort gases in the retort tube 2 is monitored by a temp gauge 22. Two vent stacks 23 vent combusted gases from the furnace 3. Butterfly valves 24 are adjusted to regulate the outflows of the combusted gases through the two vent stacks 23 so as to maintain an equal pressure between the combusted gases within the furnace 3 and the atmospheric pressure.

When the pyrolysis process is just beginning, the combustible gas that is burned in burner cups 5 is PREHEATING GAS IN 6 received from an external supply (not shown) via feed line 7 and valve 8. The valve 8 is opened, and the burner cups 5 are ignited, in order to commence the pyrolysis process which, upon reaching a quiescent condition, will sustain itself. The produced off-gas(es) 9 resultant from the pyrolysis are extracted for the retort tube 2.

In general, each stream of waste, such as WASTE IN 1, will have, even if heterogeneous, a temperature, or a range of temperatures, at which pyrolysis will best transpire in realizing those results that are at any one time desired. For example, if a larger percentage char is desired then the temperature of retort tube 2 is maintained relatively lower by extracting and burning less produced off-gas(es) 9. Normally, however, it is desired to extract maximum energy from the steam of input waste, or the WASTE IN 1. In order to do so as much of the waste as is possible is distilled into gas at a relatively high temperature in the retort tube 2 without raising the temperature so high that metals and other contaminants that cannot be incinerated to harmlessness during the subsequent burning of the produced off gas(es) 9 (in a manner to be explained) are driven to enter the produced off gas(es) 9.

The produced off gas(es) 9, already heated from the pyrolysis transpiring in the retort tube 2, are superheated in their passage to the burner cups 5. The produced off gas(es) 9 so passes via a plenum 11 that is partially in the shape of a truncated pyramid in the substantial cross-section of an inverted letter "V" and partially in the shape of an elongate box, or chamber, that supports the burner cups 5. The burner cups 5 are affixed to the top of a lower part, or elongate box, or chamber of the plenum 11. The produced off-gas(es) 9 from the retort tube 2 are directed by the pyramid-shaped upper portion of plenum 11 into the box-shaped lower portion of plenum 11. From the box-shaped lower portion of plenum 11 the produced off gas(es) 9 enters into the burner cups 5. In this manner the plenum 11 serves to convey the produced off-gas(es) 9 to the burner cups 5 and, moreover, to so convey the produced off-gas(es) 9 along a path over which they will be superheated by the combustion transpiring in the burner cups 5.

A compressed air conduit 12 conveys compressed air, or AIR IN 13 though a first air valve 14 and arrayed air valves 15 to air injection orifices 51 that are respectively individually associated with each of the burner cups 5. The air conduit 12 passes in a position over the tops of the burner cups 5, and over the top of the combustion transpiring in the burner cups 5, in path that is only diagrammatically suggested in FIG. 1 for the purposes of clarity. This path is made increasingly clear in the functional schematic of FIG. 2. This passage serves to heat (or pre-heat) the air in the air conduit 12. The air conduit 12 is comprised of a number of lines, or tubes (only a partial number eight (8) of which are shown in FIG. 1) each of which passes through the lower, box, portion of the plenum 11, each directly into a respective one of the burner cups 5. The manner by which both the produced off-gas(es) 9 and the AIR IN 13 are finally delivered to each of the burner cups 5 will be more completely shown in FIG. 3. The significance of the single air valve 14, and the plural air valves 15, will be more completely discussed in conjunction with FIG. 2.

For the moment, it is sufficient to understand that exhaust gases resulting from the combustion in the burner cups 5 serves to heat all that is located above the burner cups, and particularly (i) the retort tube 2 and its contained WASTE IN 1, (ii) the upper part of the plenum 11 that is located above the burner cups 5, and (iii) the lines of the air conduit 12 that are also located above the burner cups 5.

The entire retort tube 2 and the burner cups 5, as well as the entire plenum 11 and a portion of the lines of the air conduit 12, are located within the furnace 3. The furnace 3 is preferably, and normally, lined with fire brick serving as a refractory lined enclosure 32. Exhaust gases form the combustion transpiring in the burner cups 5 are ultimately vented through the furnace vent 33.

Figure 2:
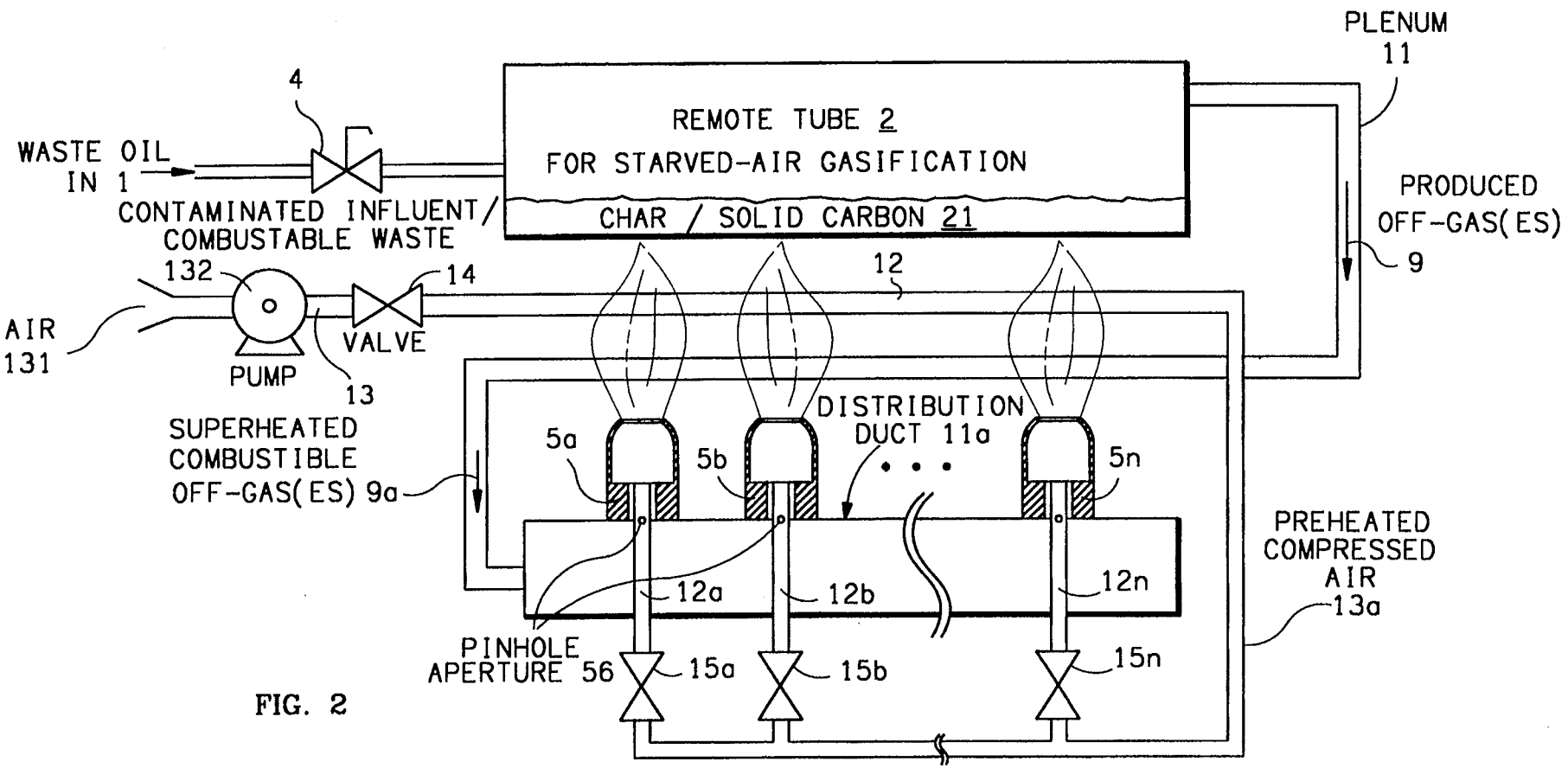
FIG. 2 is a schematic flow diagram of the improved process of the present invention, previously illustrated in FIG. 1, particularly showing both (i) superheating of combustible off-gas(es) produced by the process of pyrolysis, and (ii) preheating of compressed air, prior to incinerating the off-gas(es) in the compressed air.

A schematic flow diagram of the improved process and pyrolysis system of the present invention, previously diagrammatically illustrated in FIG. 1, is shown in FIG. 2. FIG. 2 particularly shows both (i) the superheating of combustible off-gas(es) produced by the process of pyrolysis, and (ii) preheating of compressed air, prior to incinerating the off-gas(es) in the compressed air. Both this (i) superheating and (ii) preheating are important to the present invention. By the time the combustible off-gas(es) and the compressed air are combusted in the relatively small, relatively high surface area to combustion (flame) volume burner cups, both the combustible off-gas(es) and the compressed air will be so extremely hot that combustion in the burner cups will transpire very completely, and cleanly. This will be the case regardless that the surfaces of the cups should be relatively large relative to the volume of the combustion reaction, which would normally serve to quench the combustion reaction. This will be the case regardless that combustion products will be somewhat impeded in their escape from the combustion volume, which would again normally serve to quench the combustion reaction.

Referencing FIG. 2, the WASTE IN 1 is generally any CONTAMINATED INFLUENT/COMBUSTIBLE WASTE, and may particularly be liquid such as, for example, used motor oil. The input valve 4 may be, and preferably is, opened to a variable extent to control the inrush of the WASTE IN 1, which is normally under a slight hydrostatic pressure.

The pyrolysis, or starved air gasification, occurring in the RETORT TUBE 2 produces CHAR, or SOLID CARBON 21, that substantially settles to the bottom of the RETORT TUBE 2. Additionally produced is the PRODUCED OFF-GAS(ES) 9, which are more generally described as the effluent, or combustible off-gas(es) of classical pyrolysis.

Continuing in FIG. 2, atmospheric AIR 131 is compressed in a PUMP 132 (shown in phantom line for not being a part of the pyrolysis and pyrolysis off-gas combustion system of the present invention) to produce the compressed AIR IN 13 previously seen in FIG. 1. The amount of the flow of this AIR IN 13 may be, and preferably is, controlled by a variable air VALVE 15 and, additionally, by plural air valves 15*a*, 15*b*, . . . 15*n* as are respectively individually associated with each of the burner cups 5*a*, 5*b*, . . . 5*n*. The compressed AIR IN 13 flows in the air conduit 12.

The PRODUCED OFF-GAS(ES) 9 are heated in during their passage through PLENUM 11 because the PLENUM 11 is routed through the combustion gases, if not also the actual flame fronts, of the burner cups 5*a*–5*n* (previously collectively seen as burner cups 5 in FIG. 1). After the PRODUCED OFF-GAS(ES) 9 are heated into SUPERHEATED COMBUSTIBLE OFF-GAS(ES) 9*a*, this (these) GAS(ES) 9*a* are further distributed in the DISTRIBUTION DUCT 11*a*, or the lower portion of PLENUM 11, to each of the burner cups 5*a*–5*n*. The precise manner by which the SUPERHEATED COMBUSTIBLE OFF-GAS(ES) 9*a* are received into a typical one of the burner cups 5*a*–5*n* will be more particularly shown in FIG. 3.

Meanwhile, the compressed AIR IN 13 flowing in the air conduit 12 is also heated, similarly to the heating of the PRODUCED OFFGAS(ES) 9 in the PLENUM 11, by the routing of conduit 12 through combustion the gases, if not also the actual flame fronts, of the burner cups 5*a*–5*n* (previously collectively seen as burner cups 5 in FIG. 1). After the compressed AIR IN 13 is heated it becomes PREHEATED COMPRESSED AIR 13*a*. As previously explained, this PREHEATED COMPRESSED AIR 13*a* is preferably distributed through a separate burner control valve 15*a*, 15*b*, . . . 15*n* (previously collectively seen as burner control valves 15 in FIG. 1) to each of the burner cups 5*a*, 5*b*, . . . 5*n*. The total supply of compressed AIR IN 13 to the combustion reactions in the several burner cups 5*a*, 5*b*, . . . 5*n* is thus a combination of the opening of the control VALVE 14 affecting all the burner cups 5*a*, 5*b*, . . . 5*n* in common and the individual setting of an associated burner control valve 15*a*, 15*b*, . . . 15*n*.

Figure 3:
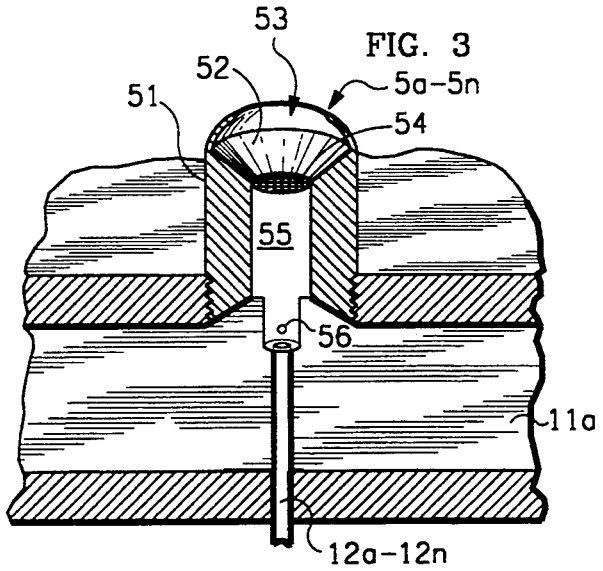
FIG. 3 is a cut-away side plan view of the preferred embodiment of a burner cup in accordance with the present invention, which burner cup is used in the incineration of off-gas(es) produced by pyrolysis.

As previously stated, the precise manner by which the PREHEATED COMPRESSED AIR 12 is received into a typical one of the burner cups 5*a*, 5*b*, . . . 5*n* will be more particularly shown in FIG. 3. Each of the burner cups 5*a*, 5*b*, . . . 5*n* includes a pinhole aperture 56 that serves to bleed a small amount of non-compressed gaseous mixture from inside the distribution duct 11*a* into the combustion reaction.

A cut-away side plan view of the preferred embodiment of a burner cup 5*a*–5*n* in accordance with the present invention, which burner cup 5*a*–5*n* is used in the incineration of off-gas(es) produced by pyrolysis, is shown in FIG. 3. A burner cup body 51 engages, normally by threading, the top of the DISTRIBUTION DUCT 11*a* portion of PLENUM 11 (shown in FIG. 2). The burner cup body 51 presents to the uppermost a partially-enclosed dome 52 having circular symmetry and the substantial cross-section of a trapezoid. A circular aperture 53 is presented at the very top of the dome 52 to the burner cup body 51. A base to the dome 52 is provided by a screen 54 that resides directly above a mixing chamber 55. A pinhole aperture 56 serves to admit SUPERHEATED COMBUSTIBLE OFF-GAS(ES) 9*a* (shown in FIG. 2) from the inside of the DISTRIBUTION DUCT 11*a* portion of PLENUM 11 (both shown in FIG. 2) into the mixing chamber 55. The SUPERHEATED COMBUSTIBLE OFF-GAS(ES) 9*a* are drawn into the mixing chamber 55 through the pinhole aperture 56 by a suction created from the flow of PREHEATED COMPRESSED AIR 13*a*.

This PREHEATED COMPRESSED AIR 13*a* (shown in FIG. 2) is supplied to the mixing chamber 55 through the air distribution lines 12*a*–12*n*. Note that, since the mixing chamber 55 is nearly as narrow at the point of pinhole aperture 56 as is the air distribution line 12*a*–12*n*, the flow velocity of the PREHEATED COMPRESSED AIR 13*a* in the mixing chamber 56 at the point of pinhole aperture 56 will scarcely be diminished over what it is inside the air distribution line 12*a*–12*n*, and this flow of the PREHEATED COMPRESSED AIR 13*a* will be effective to suck SUPERHEATED COMBUSTIBLE OFF-GAS(ES) 9*a* from the inside of the DISTRIBUTION DUCT 11*a* through the pinhole aperture 56 at this location.

Accordingly, PRODUCED OFF-GAS(ES) 9, already heated into SUPERHEATED COMBUSTIBLE OFF-GAS(ES) 9*a* (both shown in FIG. 2) are supplied into the mixing chamber 55 to be mixed with PREHEATED COMPRESSED AIR 13*a* (shown in FIG. 2) supplied through the air distribution lines 12*a*–12*n*. Meanwhile, the AIR 131—compressed to become compressed air 13 and preheated to become PREHEATED COMPRESSED AIR 13*a* (all shown in FIG. 2)—is ultimately supplied to the mixing chamber 55 through the air distribution lines 12*a*–12*n*. The combustible off-gas(es) and air mix within the mixing chamber 55. The mixed combustible off-gas(es) and air are passed under pressure through the screen 54 and into the circularly-symmetric trapezoidally-shaped, or cupped, combustion chamber 53 under the partially-enclosed dome 52.

In operation of each burner cup 5*a*–5*n*, SUPERHEATED COMBUSTIBLE OFF-GAS(ES) 9*a* is combusted with PREHEATED COMPRESSED AIR 13*a* in the region of the chamber 53 above the burner plate 54 and mostly in the region below the partially-enclosed dome 52. Gaseous mixing in this volume, which mixing has already started in the mixing chamber 55, is promoted by the screen 54. The combustion of the SUPERHEATED COMBUSTIBLE OFF-GAS(ES) 9*a* in the presence of stoichiometric oxygen that is within the PREHEATED COMPRESSED AIR 12 transpires substantially completely within the enclosed volume of the combustion chamber 53 substantially under the partially-enclosed dome 52.

This combustion chamber 53 presents a considerably more confined volume than is typical for such full and unfettered as was previously believed to be the best way to ensure clean combustion. It is clear that the interior surfaces of the combustion chamber 53 part of each burner cup 5*a*–5*n* not only assume a relatively higher ratio to the volume of the same combustion chamber 53 as the burner cup 5*a*–5*n* (and the combustion chamber 53) become relatively smaller, as is preferred in the present invention, but that, also, the combustion chamber 53 is itself not fundamentally shaped so as to minimize surface area. The relatively high surface area-to-volume of a small combustion chamber 53 might normally be considered to adversely quench the combustion reaction, inducing incomplete combustion producing undesirable pollution products. Furthermore, it is obvious that the constricted aperture dome 52 opening to the combustion chamber 53 serves to somewhat impede the escape of combustion products form the from the combustion chamber, again potentially serving to partially quench the combustion reaction in a manner not previously perceived to be desirable.

Previous limitations on quenching of the combustion reaction are completely overcome in the present invention because both the combustible off-gas(es) and the compressed air are so extremely hot by the time that they are combusted in the relatively small, relatively high surface area to combustion (flame) volume, combustion chamber 53 of each burner cup 5*a*–5*n*. The combustion in each burner cup 5*a*–5*n* transpires very completely, and cleanly, in a manner that would not be possible with (i) larger, less precisely controllable and controlled combustion (in a manner to be explained) volume (i.e., larger burner cups), and/or (ii) with such unfettered venting, or dispersion, of the products of combustion as might permit that some combustibles themselves might escape unreacted, or, if reacted, then reacted at such sub-optimal combustion stoichiometric conditions and temperatures as result in the formation of undesired pollutants.

In detail, egress of the combustion by-products from the combustion chamber 53 is slowed, even though both combusted gas flows and especially the PREHEATED COMPRESSED AIR 12*a* are introduced under pressure, because the top opening, or aperture, to the dome 52 is less large than is the maximum extent of the combustion chamber 53 under the dome 52 and is, indeed, scarcely larger (or even equal to, or smaller than) the screen 54. Each PINHOLE APERTURE 56 (shown in FIG. 2) serves to bleed but a fractional portion of total non-compressed PREHEATED COMBUSTION OFF-GAS(ES) 9*a* from inside the DISTRIBUTION DUCT 11*a* portion of PLENUM 11 (both shown in FIG. 2) into the combustion reaction. The amount of the SUPERHEATED COMBUSTIBLE OFF-GAS(ES) 9*a* (shown in FIG. 2) combusted in the combustion chamber 53 of any individual one of the combustion cups 5*a*–5*n* is generally only a small amount; such an amount as would be more readily associated with, for example, the jet of a burner of a household gas range than with, for example, the larger burner of an oil furnace.

The overall apparatus for the incineration of combustible off-gas(es) produced by the process of pyrolysis of solid waste in accordance with the present invention is adjusted for clean, low-pollution, combustion in two steps. First, each small, and small volume, combustion reaction is precisely adjusted so that the amount of the PREHEATED COMPRESSED AIR 13*a* (shown in FIG. 2) bled though the pinhole aperture 56 of each of the combustion cups 5*a*–5*n* is optimal for full and clean combustion. This adjustment is made by setting the diameter of the pinhole aperture 56 relative to the diameter, and flow rate of compressed air, in the air distribution lines 12*a*–12*n*. For a preset compressed air flow rate in the middle of the expected adjustable range (adjustment of the flow rate is nest to be discussed), and for an average production rate of OFF-GAS(ES) 9 associated with an average flow of WASTE IN 1 (shown in FIG. 1), the pinhole aperture 56 is set in diameter so that the flame of combustion within the burner cup 5*a*–5*n* shows blue, and is clean. Once set, the diameter of the pinhole aperture 56 is fixed.

Non-uniformity in the distribution of the PRODUCED OFF-GAS(ES) 9 to the several burner cups 5a–5n is inevitable due to the complex shape and contours of the plenum 11, and of the flow of the PRODUCED OFF-GAS(ES) 9 therein. The combustion between the several burner cups 5a–5n is balanced so that each cup burns substantially evenly by separate adjustment of the air flow valves 15a–15n (shown in FIG. 2). The adjustment of each valve for even combustion in the associated burner cup 5a–5n is easily determined simply by observing the flame of the burner cup 5a–5n, and by adjusting the valve so as to make the flames of the several burner cups substantially equal.

Then, as the temperature of the retort 2 detected by temperature gauge 22 (both shown in FIG. 1) varies about an optimal temperature for pyrolysis of the waste steam, the valve 4 is controlled to admit varying amounts of WASTE IN 1. As the sensed temperature falls below optimal level the amount of WASTE IN 1 admitted by valve 4 per unit time is increased, commensurately increasing the rate of pyrolysis in the retort 2 and, ultimately, the rate of the combustion in the burner cups 5 of the off-gas(es) produced by the pyrolysis. This increased burning raises the temperature of the retort 2 back to the desired level. Conversely, as the sensed temperature rises above optimal level, the amount of WASTE IN 1 admitted by valve 4 per unit time is decreased, commensurately decreasing the rate of pyrolysis in the retort 2 and, ultimately, the rate of the combustion in the burner cups 5 of the off-gas(es) produced by the pyrolysis. This decreased burning now lowers the temperature of the retort 2 back to the desired level.

The amount of compressed air supplied to the burner cups 5 for the combustion of the PRODUCED OFF-GAS(ES) 9 must increase or decrease in accordance with the amount of such PRODUCED OFF-GAS(ES) 9 being burned. As the arrayed burner cups 5a–5n must burn more or less fuel, both individually and in aggregate, the overall supply of the air in 131 is varied, normally by adjustment of the air VALVE 14. (The volume of air may potentially also be adjusted by varying the speed, and air output volume and pressure, of the air PUMP 132 (shown in FIG. 2).) Fully responsive adjustment of the flow of air in 131, and of the COMPRESSED AIR 13, by the air VALVE 14 is again in response to visual observation of the flames of combustion in the burner cups 5a–5n.

The apparatus of the present invention has the very nice property that, once the combustion of the individual burner cups 5a–5n is adjusted, then, the overall supply of compressed air being appropriately varied, the combustion will remain optimal over a broad range of the feed rates, and an associated broad range of the formation of combustible off gas(es) from the waste stream undergoing pyrolysis. The feed rate is typically variable over a range of a least three times (×3).

Figure 4:
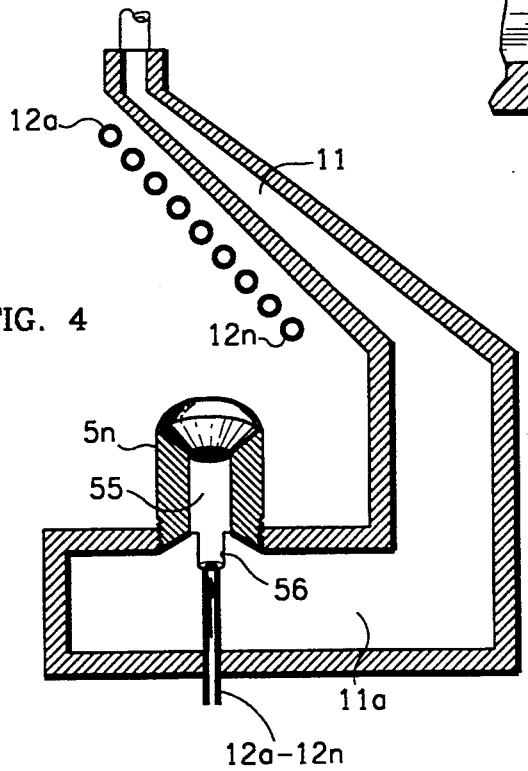
FIG. 4 is a cut-away side plan view of a portion of the preferred incineration apparatus of the present invention previously seen in FIGS. 1 and 2, and particularly showing the preferred embodiment of the burner cup previously seen in FIG. 3, both the incineration apparatus and burner cup being used in the incineration of off-gas(es) produced by pyrolysis.
Figure 5:
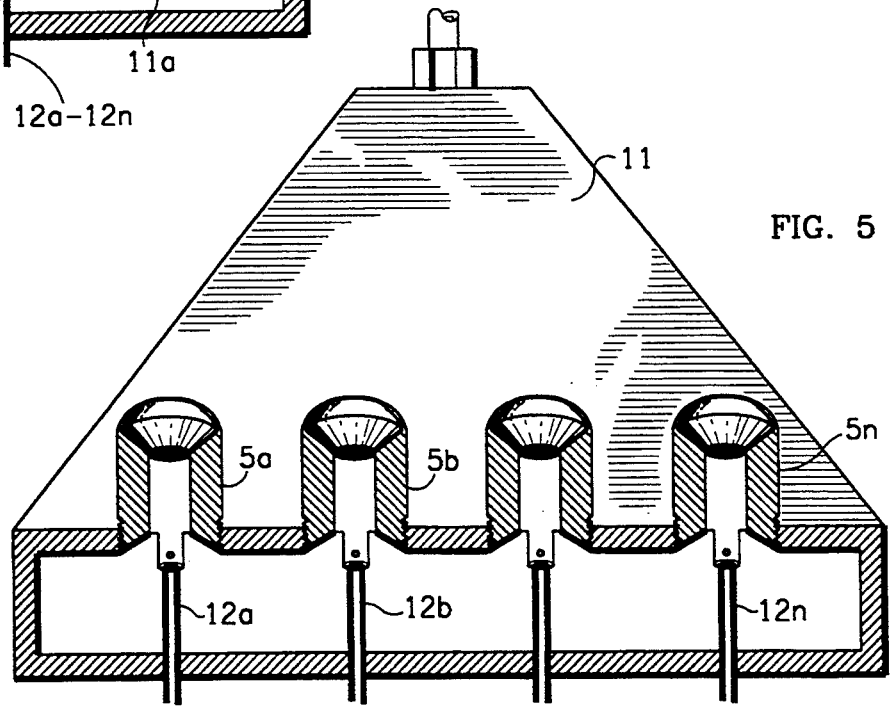
FIG. 5 is a cut-away side plan view, perpendicular to the view of FIG. 4, again showing the portion of the preferred incineration apparatus of the present invention previously seen in FIGS. 1, 2 and 4, and particularly showing several of the preferred embodiments of the burner cup previously seen in FIG. 3, both the incineration apparatus and burner cup being used in the incineration of off-gas(es) produced by pyrolysis.

A cut-away side plan view of a portion of the preferred incineration apparatus of the present invention previously seen in FIGS. 1 and 2, and particularly showing the preferred embodiment of the burner cup previously seen in FIG. 3, is shown in FIG. 4. Likewise, a cut-away side plan view, perpendicular to the view of FIG. 4, again showing the portion of the preferred incineration apparatus of the present invention previously seen in FIGS. 1, 2 and 4, and again particularly showing several of the preferred embodiments of the burner cup previously seen in FIG. 3, i shown in FIG. 5. Both the incineration apparatus and the burner cups are, in accordance with the present invention,used in the incineration of off-gas(es) produced by pyrolysis. FIGS. 4 and 5 particularly illustrate the way in which the burner cups 12a–12n are arrayed below both (i) the compressed air distribution lines 12a–12n for preheating the compressed air 13 (shown in FIG. 2) carried in these lines, and (ii) the plenum 11 for superheating the PRODUCED OFF-GAS(ES) 9 (shown in FIG. 2) carried in the plenum 11.

Figure 6:
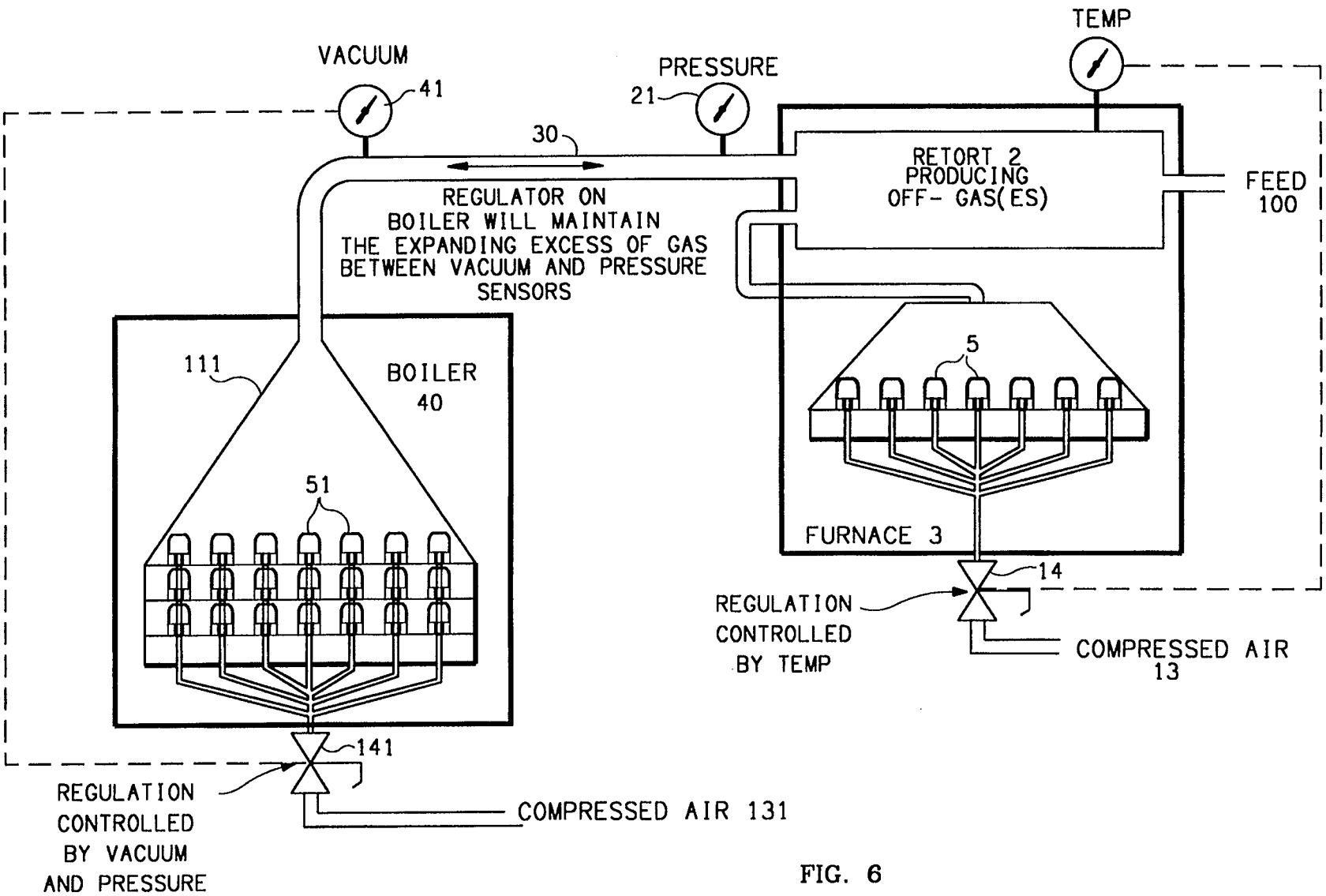
FIG. 6 is a diagrammatic view of a system using the improved process and apparatus of the present invention for the incineration of combustible off-gas(es) produced by the process of pyrolysis in combination with an auxiliary combustion chamber for heating a boiler, both a control feedback path based on temperature and another based on vacuum pressure being shown.

A diagrammatic view of a complete waste disposal and waste energy recovery system using the improved process and apparatus of the present invention for the incineration of combustible off-gas(es) produced by the process of pyrolysis is shown in FIG. 6. The RETORT 2 is PRODUCING OFF GAS(ES) by process of pyrolysis from the FEED, or WASTE IN 1 as it previously called in FIG. 1. In so doing heat developed by combustion of the produced off-gas(es) in the presence of stoichiometric COMPRESSED AIR 13 (previously called AIR IN 13 in FIGS. 1 and 2) in burner cups 5 is used. Both the RETORT 2 and the burner cups 5 are within the FURNACE 3 (previously seen in FIG. 1). The temperature within the RETORT 2 is sensed by the temperature gauge TEMP 22 (previously seen in FIG. 1) and feed back to control the compressed air intake valve 14 (previously seen in FIGS. 1 and 2). Accordingly, REGULATION (of combustion within the burner cups 5 is) CONTROLLED BY TEMP(erature). The magnitude of the feedback control loop based on temperature is readily empirically adjustable over a broad, and useful, range. At any point within the range the flames within the (collective) burner cups 5 may simply be observed, and the amount of COMPRESSED AIR 13 passing through air valve 14 under control of the feedback loop adjusted so that the flames burn cleanly. Once the magnitude of the feedback control loop is established it need not be varied again.

Meanwhile, an excess portion of the produced off-gas(es) (i.e., that portion of the produced off gas(es) not required to sustain the temperature of the retort 2) is now extracted from RETORT 2 through conduit 30. This excess portion is flow communicated to arrayed burner cups 51 located under a BOILER 40 (or other suitable sink of the heat produced by combustion within the burner cups 51).

Notably, and in accordance with the present invention the burner cups 51 are preferably of the same size, shapes, arrayed multiplicities, and principle of operation as are the burner cups 5 (shown in FIGS. 1–5). Namely, (i) that portion of the off gas(es) produced in the RETORT 2 that is routed to these burner cups 51 (collectively) is kept superheated, or is again superheated by burner cups 51 as required. Namely, (ii) the COMPRESSED AIR 131 is pre-heated, normally by the combustion transpiring in the burner cups 51. Note that this (i) superheating and (ii) pre-heating is not explicitly shown in FIG. 6 as is, in contrast, the plural numbers of the burner cups 51. However, by this time the reader should understand that this (i) superheating and (ii) pre-heating are precisely why the relatively small and numerous burner cups 51 may be effectively used for low-pollution efficient combustion. The reader will also understand that when plural burner cups are shown (as in FIG. 6, and as will again occur in FIG. 7), then the temperature of the off-gas(es) and air supplied to these burner cups has been elevated.

Continuing in FIG. 6 with the control, as opposed to the elevation in temperature, of the supplies of (i) offgas(es) and (ii) compressed air, it is again (i.e., as was the case with the burner cups 5) the supply of the compressed air 131 that is regulated. However, this REGULATION (is now) CONTROLLED BY VACUUM AND PRESSURE. Namely, the pressure of the off-gas(es) at the RETORT 2 is sensed by a pressure gauge 21. Meanwhile, a lower pressure, or vacuum, is sensed by a downstream VACUUM gauge 41, (normally located far downstream at the location of the plenum 111 supplying the off-gas(es) to the burner cups 51 for greatest pressure differential). The difference between these two pressures is an indication of the amount of excess off-gas(es) produced in the retort 2. The difference between these two pressures is used to control in air valve 141 the amount of COMPRESSED AIR 131 supplied to the burner cups 51. This control permits the proper amount of air to be combined with the excess off-gas(es) (that resulted from the pyrolysis in retort 2) for an efficient clean combustion of the off-gas(es) in burner cups 51 over a broad range of flow, and burn, rates. In other words, the REGULATION ON (the) BOILER (40) WILLMAINTAIN THE EXPANDING EXCESS OF GAS BETWEEN (the) VACUUM and (the) PRESSURE SENSORS (41 and 21, respectively). This is tantamount to saying that such excess off-gas(es) as are produced will be cleanly burned in the burner cups 51.

Adjustment of the magnitude of this second feedback control loop is again a straightforward matter. This second feedback control loop based on pressure is again readily empirically adjustable over a broad, and useful, range. At any point within the range the flames within the (collective) burner cups 51 are simply observed, and the amount of COMPRESSED AIR 131 passing through air valve 141 under control of the second feedback loop is adjusted so that the flames burn cleanly. Once the magnitude of the feedback is adjusted, no further tailoring of the control loop is required The air valve 141 itself will, of course, be subject, under the feedback control loop, to continuous adjustment in accordance with the amount of excess off-gas(es) to be burned.

Accordingly, FIG. 5 has shown both a control feedback loop based on temperature and another based on vacuum pressure.

Still yet another, third, control loop (not shown) could exist between a sensed temperature of the boiler 40 and the rate of the supply of FEED 100 (previously called WASTE IN 1 in FIGS. 1 and 2). As the temperature of boiler 40 was desired to be raised the supply of FEED 100 would be increased.

Figure 7A:
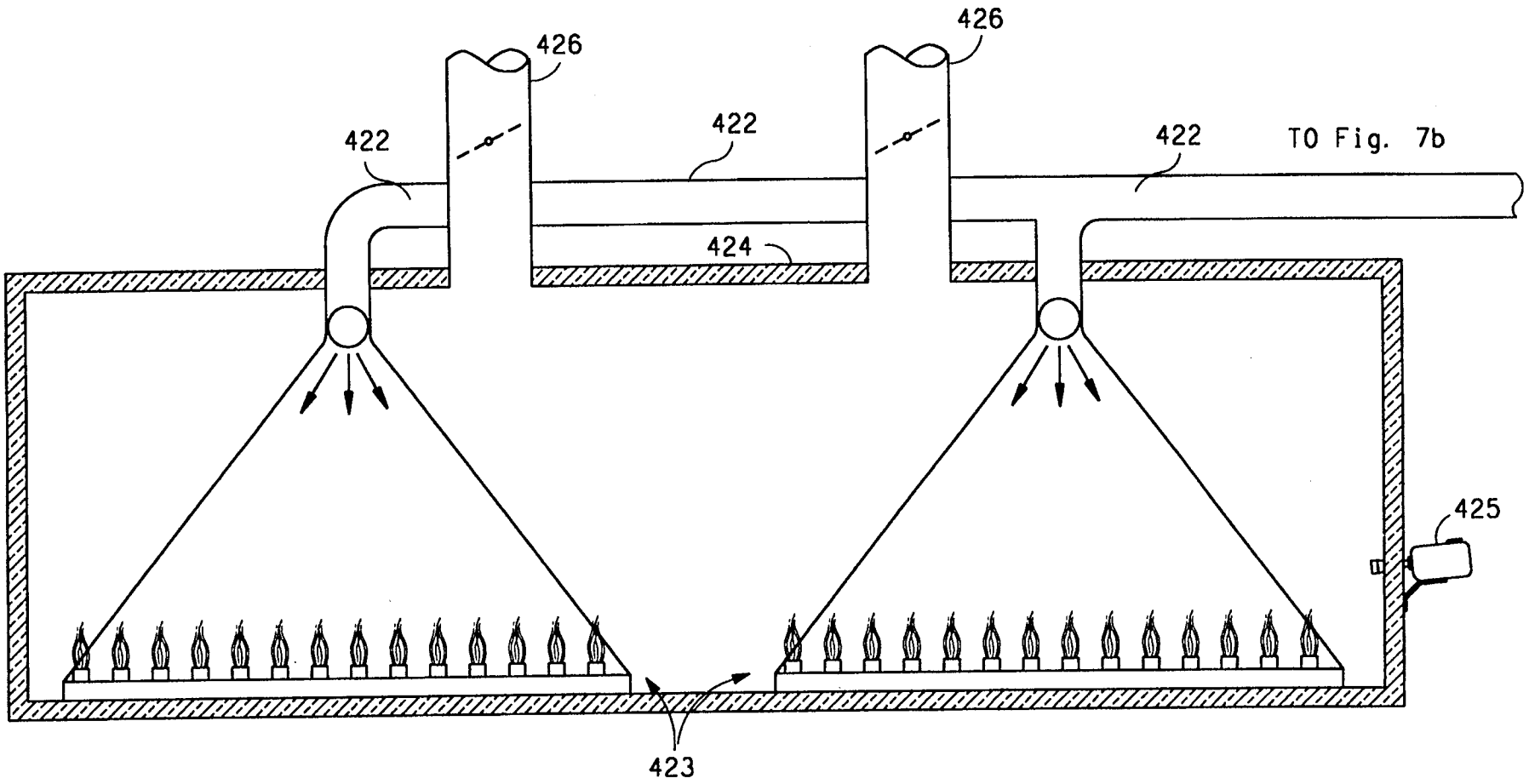
FIG. 7, consisting of FIG. *7a* and FIG. *7b*, is a diagrammatic representation of an automated waste disposal system using the improved process and apparatus of the present invention for the incineration of combustible off-gas(es) produced by the process of pyrolysis.
Figure 7B:
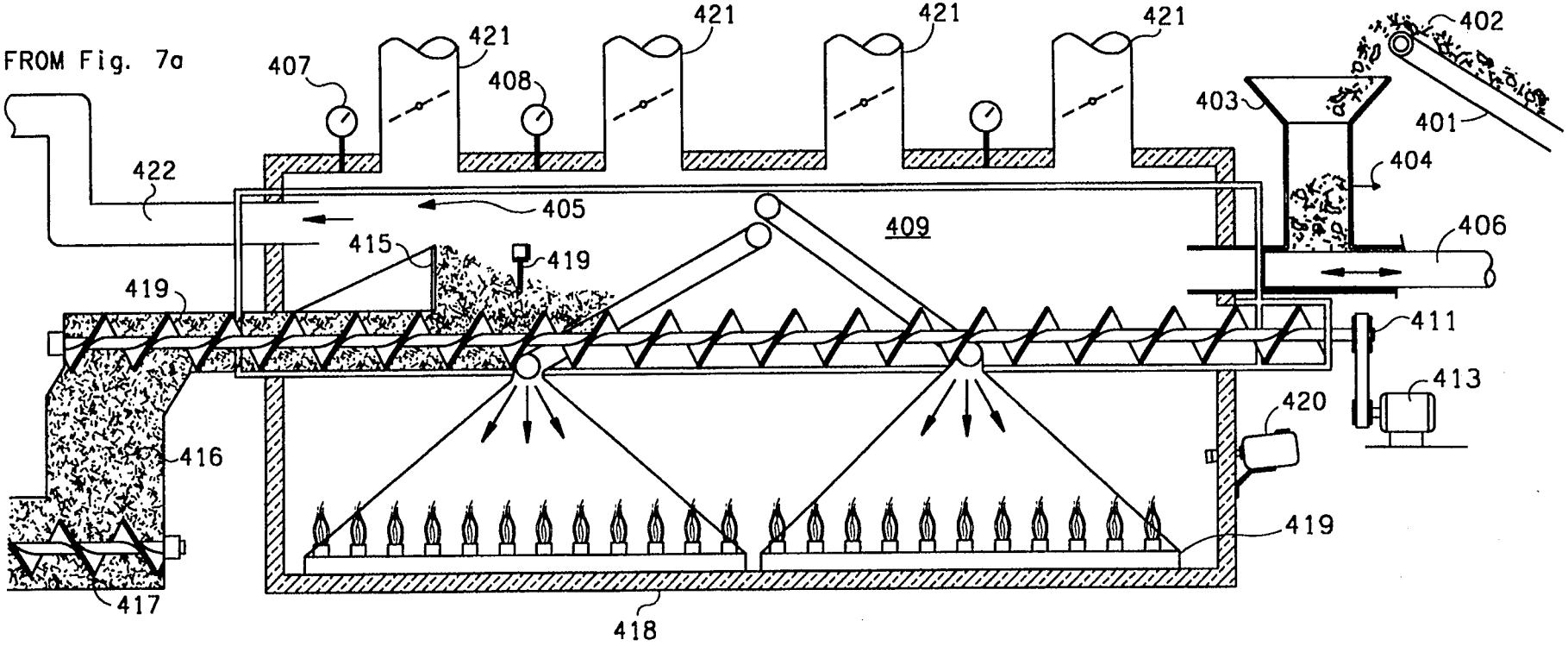

A cut-away side plan view of another embodiment, alternative to the embodiment shown in FIG. 1, of an improved process and apparatus for the incineration of combustible off-gas(es) produced by the process of pyrolysis of solid waste in accordance with the present invention is shown in FIG. 7, consisting of FIG. 7*a* and FIG. 7*b*. The same principles of the present invention as were within the previous embodiment of FIG. 1 will be recognized.

Instead of liquid waste, including waste oil, a conveyor belt 401 serves to deliver solid waste 402 to a hopper 403 at a variable rate under control of a solid waste sensor 404 sensing the level of solid waste in the hopper 403. The delivery of the solid waste 402 from the hopper 403 into the retort 405 is under control of an adjustable speed ram 406. The ram 406 is cycled in accordance with detection by the vacuum gauge 407 and temperature gauge 408 that pyrolysis transpiring within the retort 405 is desirous of receiving more, or less, fuel.

Pyrolysis of the solid waste 402 produces off-gas(es) that are carried in the produced gas lines 409 and char 410. The char 410 is continuously or periodically scrapped from the bottom of the retort 405 by the adjustable speed char screw 411 driven in rotation at variable speed within the screw pipe 41 under force of motor 413. The speed and/or duty cycle of the motor 413 to remove the accumulated char 410 from the retort 405 is in response to solid level sensor 414 particularly as is reliably able to sense the level of char 410 accumulated against char stop 415. The screw-evacuated char 410 falls down an exit char chute 416 and is further transported by another exit screw 417. The char chute 416 is typically long, and the both the exit screw 417 and the path of the evacuated char 410 therethrough are in some degree of thermal isolation, which may be promoted by insulation (not shown) from the retort 405 and the adjustable speed char screw 411. In accordance with the principles of the present invention, this thermal isolation helps to prevent that significant energy should be lost in a path through the screw mechanisms that serve to evacuate the hot char 410 from the retort 405.

The retort 405 is entirely contained within an insulated furnace 418. Also contained within the insulated furnace 418 are the burner cups 419 and, in accordance with the present invention, the gas plumbing by which both the produced gas carried in produced gas lines 409 and the compressed air (not shown) are heated (superheated or preheated, as the case may be) on their way to the burner cups 419. The combustion reaction(s) transpiring in the furnace burner cups 419 is monitored with video camera 420. The gaseous by-products of combustion in the combustion cups 420, and in the furnace 418, are vented through furnace vents 421.

In the embodiment of FIG. 4, some of the produced gas from the pyrolysis transpiring within the retort 405 is flow-conducted by produced gas lines to boiler 422 to a yet another, separate, set of burner cups, the combustion cups 423. Combustion transpires in these combustion cups 423 to the end of supplying heat energy to the boiler 424 in a manner that is in essential aspects substantially equivalent to the manner by which combustion transpires in the burner cups 419 for the purpose of supplying the heat of pyrolysis (in the retort 405). Namely, the produced gas carried in the produced gas lines to boiler 422 is either superheated in the insulated furnace 418 by passage of the produced gas lines to boiler 422 proximate to the burner cups 419 (path not shown) or, alternatively, proximate to the combustion cups 423 (path not shown). Namely, the compressed air (not shown) is still preheated, as the case may be) on its way to the combustion cups 423. The combustion transpiring in the combustion cups 42*e* is monitored by video camera 425 in a like manner that the combustion transpiring in the burner cups 419 is monitored by video camera 420. The gaseous by-products of combustion in the combustion cups 423 are vented through boiler vents 426.

In accordance with the preceding discussion, still further adaptations and embodiments of the present invention will suggest themselves to a practitioner of the combustion engineering arts. For example, the transference of heat energy from the combustion reaction transpiring within the burner cups to either, or both, of the off-gas(es) and/or the compressed air could transpire indirectly via heat-conducting metal paths, as opposed to directly.

In accordance with the preceding explanation, the present invention should be interpreted broadly, and in accordance with the following claims only, and not solely in accordance with that particular embodiment within which the invention has been taught.

What is claimed is:

1. In the combined processes of pyrolyzing a stream of carbonaceous material in the presence of heat and in the absence of stoichiometric oxygen to produce as products of pyrolysis (i) an off-gas having a combustible content and (ii) char, and burning the combustible off-gas product of pyrolysis to produce (i) heat and (ii) combustion products including emissions that are undesirable, odorous and/or hazardous, an improvement directed to reducing said emissions comprising:

superheating off-gas that is produced by the pyrolyzing at a later time with at least some of the heat resulting from the burning of off-gas that was produced by the pyrolyzing at an earlier time; and providing a forced flow of a gaseous mixture containing oxygen in an amount stoichiometric to the burning of the superheated off-gas;

wherein the superheating of the off-gas, under equal gaseous pressure, promotes molecules that are within the off-gas to a higher degree of separation that induces a burning of these molecules of the off-gas in the presence of stoichiometric oxygen with greater efficiency and with less emissions than when the superheating is not transpiring.

2. The improvement to the combined processes of pyrolyzing and burning according to claim 1 wherein the improvement further comprises:

preheating the forced flow of the gaseous mixture containing oxygen with at least some of the heat resulting from the burning of the off-gas;

wherein, both the (i) off-gas and the (ii) gaseous mixture containing oxygen are heated prior to being burned, and the burning is suitable to reduce emissions to the extent that the off-gas is more efficiently and completely burned under very hot conditions of combustion.

3. The improvement to the combined processes of pyrolyzing and burning according to claim 2 wherein the improvement further comprises:

using essentially all of the heat energy resulting from the burning of the off-gas for the (i) superheating of the off-gas, and the (ii) preheating of the forced flow of the gaseous mixture containing oxygen;

wherein the (i) off-gas and the (ii) gaseous mixture containing oxygen that are burned are jointly heated by use of essentially all the energy that is available from burning the off-gas with and in the gaseous mixture containing oxygen and the burning is suitable to reduce the emissions to the extent that the off-gas is more efficiently and completely burned under very hot conditions of combustion.

4. The improvement to the combined processes of pyrolyzing and burning according to claim 2 wherein the burning of the (i) superheated off-gas and the (ii) preheated gaseous mixture containing oxygen transpires in a multiplicity of burner cups having walls surrounding a flame of combustion, and numbered and sized so as to each substantially produce a substantially clean flame of combustion;

wherein any quenching of the combustion reaction by contact of the (i) off-gas and (ii) gaseous mixture containing oxygen with the walls of the burner cups is substantially inconsequential because both the (i) off-gas and the (ii) gaseous mixture containing oxygen are already very hot prior to combustion.

5. The improvement to the combined processes of pyrolyzing and burning of according to claim 4 wherein the burning transpiring in the multiplicity of walled burner cups further comprises:

impeding and restraining by the walls of the burner cups any full and free flow of the combustion products from the cups;

wherein the impeding and restraining action of the walls does not serve to substantially decrease the combustion efficiency, nor to increase the undesirable and odorous gaseous emissions of combustion, as would be the normal consequence of impeding the escape of the gaseous products of combustion but, instead, serves to result in even more complete combustion because both the (i) off-gas and the (ii) gaseous mixture containing oxygen are already very hot, and their burning in the multiplicity of burner cups transpires over a longer period of time than when the escape of the combustion products was not impeded by the walls of the burner cups, and thus transpires more completely.

6. A system for both pyrolyzing a stream of carbonaceous material in the presence of heat and in the absence of stoichiometric oxygen to produce (i) an off-gas having a combustible content and (ii) char, and for burning a pyrolysis product where the combustible off-gas is burned to produce (i) heat and (ii) combustion products including emissions that are undesirable, odorous and/or hazardous, the pyrolyzing and burning system comprising:

a chamber;

a retort, located within the chamber, for receiving the stream of carbonaceous material and for pyrolyzing the stream in the presence of heat and in the absence of stoichiometric oxygen to produce (i) an off-gas having a combustible content and (ii) char;

a burner means located within the chamber for burning the off-gas to heat the retort;

a first conduit means within the chamber for conducting the off-gas produced by the retort to the burner along a path where it is superheated by the burning transpiring in the burner means; and a second conduit means within the chamber for supplying the burner means with a sufficient flow of a gaseous mixture containing oxygen so that the burning of the superheated off-gas in the burner means transpires stoichiometrically.

7. The system according to claim 6 further wherein the second conduit means proceeds along a path where the gaseous mixture flowing within the second conduit is preheated by the burning transpiring in the burner means;

wherein both the (i) off-gas flow-conducted by the first conduit, and the (ii) gaseous mixture containing oxygen flow-conducted by the second conduit, that are burned in the burner means are heated prior to being so burned.

8. The system according to claim 7 wherein the burner means comprises:

a multiplicity of walled burner cups numbered and sized so as to each burn the (i) superheated off-gas and the (ii) preheated gaseous mixture containing oxygen so as to substantially produce a substantially clean flame of combustion.

9. The system according to claim 8 wherein the each of the multiplicity of walled burner cups further comprises:

a bulbous chamber serving to impede and restrain by its shape any full and free flow of the combustion products from the chamber as would normally result from, among other gas dynamical forces including forces resulting from combustion, a force of the flow of the gaseous mixture containing oxygen.

10. A system for pyrolysis of a stream of carbonaceous material in the presence of heat and in the absence of stoichiometric oxygen to produce (i) an off-gas having a combustible content and (ii) char, and for burning a pyrolysis product where the combustible off-gas is burned to produce (i) heat and (ii) combustion products including emissions that are any of undesirable, odorous and hazardous, the system comprising:

a chamber;

a retort, located within the chamber, for receiving the stream of carbonaceous material and for reacting the stream in the presence of heat and in the absence of stoichiometric oxygen to produce (i) an off-gas having a combustible content and (ii) char;

a multiplicity of burner cups, located within the chamber, for burning the off-gas to heat the retort, each of the multiplicity of burner cups having and defining a chamber serving to impede and restrain by its shape any such full and free flow of the combustion products from the chamber as would normally result from gas dynamical forces of combustion;

a first conduit means within the chamber for conducting the off-gas produced by the retort to the multiplicity of burner cups along a path where it is superheated by the burning transpiring in the multiplicity of burner cups; and a second conduit means within the chamber for supplying each of the multiplicity of burner cups with a sufficient flow of a gaseous mixture containing oxygen so that the burning of the superheated off-gas in each of the multiplicity of burner cups transpires stoichiometrically.

11. The system according to claim 10 wherein the chamber of each of the multiplicity of burner cups is bulbous in its shape.

12. The system according to claim 10 wherein the second conduit means proceeds along a path where the gaseous mixture flowing within the second conduit means is preheated by the burning transpiring in the multiplicity of burner cups;

wherein both the (i) off-gas flow-conducted by the first conduit means, and the (ii) gaseous mixture containing oxygen flow-conducted by the second conduit means, that are burned in the multiplicity of burner cups are heated prior to being so burned.

* * * * *